US009359847B2

(12) United States Patent
Drenth

(10) Patent No.: US 9,359,847 B2
(45) **Date of Patent: *Jun. 7, 2016**

(54) HIGH PRODUCTIVITY CORE DRILLING SYSTEM

(71) Applicant: Longyear TM, Inc., South Jordan, UT (US)

(72) Inventor: Christopher L. Drenth, Draper, UT (US)

(73) Assignee: Longyear TM, Inc., Salt Lake City, UT (US)

( * ) Notice: Subject to any disclaimer, the term of this patent is extended or adjusted under 35 U.S.C. 154(b) by 543 days.

This patent is subject to a terminal disclaimer.

(21) Appl. No.: 13/717,421

(22) Filed: Dec. 17, 2012

(65) Prior Publication Data

US 2013/0105227 A1 May 2, 2013

Related U.S. Application Data

(63) Continuation of application No. 12/528,949, filed as application No. PCT/US2008/055656 on Mar. 3, 2008, now Pat. No. 8,333,255.

(60) Provisional application No. 60/892,848, filed on Mar. 3, 2007.

(51) Int. Cl.

| | |
|---|---|
| ***E21B 25/02*** | (2006.01) |
| ***E21B 23/00*** | (2006.01) |
| *E21B 10/02* | (2006.01) |

(52) U.S. Cl.

CPC ..... *E21B 25/02* (2013.01); *E21B 23/00* (2013.01); *E21B 10/02* (2013.01)

(58) Field of Classification Search

CPC ..... E21B 25/02; E21B 7/00; E21B 10/02; E21B 23/00; E21B 25/00

See application file for complete search history.

(56) References Cited

U.S. PATENT DOCUMENTS

| | | | |
|---|---|---|---|
| 1,643,730 | A | 9/1927 | Wild |
| 2,510,865 | A | 6/1950 | Cooper |
| 2,521,886 | A | 9/1950 | Walker |
| 2,829,868 | A | 4/1958 | Pickard |

(Continued)

FOREIGN PATENT DOCUMENTS

| | | | |
|---|---|---|---|
| AU | 2008222974 | | 3/2008 |
| AU | 2008222974 | A1 | 9/2008 |

(Continued)

OTHER PUBLICATIONS

U.S. Appl. No. 60/892,848, filed Mar. 3, 2007, Drenth (Longyear TM, Inc.).

(Continued)

*Primary Examiner* — Elizabeth Gitlin

(74) *Attorney, Agent, or Firm* — Ballard Spahr LLP

(57) ABSTRACT

High productivity core drilling systems include a drill string, an inner core barrel assembly, an outer core barrel assembly, and a retrieval tool that connects the inner core barrel assembly to a wireline cable and hoist. The drill string comprises multiple variable geometry drill rods. The inner core barrel assembly comprises a non-dragging latching mechanism, such as a fluid-driven latching mechanism that contains a detect mechanism that retains the latches in either an engaged or a retracted position. The inner core barrel assembly also comprised high efficiency fluid porting.

24 Claims, 12 Drawing Sheets

(56) References Cited

U.S. PATENT DOCUMENTS

| | | | | |
|---|---|---|---|---|
| 3,092,191 | A | 6/1963 | Austin | |
| 3,103,981 | A | 9/1963 | Harper | |
| 3,115,188 | A | 12/1963 | Cochran | |
| 3,126,064 | A | 3/1964 | Miller | |
| 3,225,845 | A | 12/1965 | Koontz | |
| 3,333,647 | A * | 8/1967 | Karich et al. | 175/247 |
| 3,004,614 | A | 10/1967 | De Witt | |
| 3,346,059 | A | 10/1967 | Svendsen | |
| 3,363,705 | A | 1/1968 | Jensen | |
| 3,461,981 | A | 8/1969 | Casper | |
| 3,494,418 | A | 2/1970 | Young | |
| 3,543,870 | A | 12/1970 | Martinsen | |
| 3,667,558 | A | 6/1972 | Lambot | |
| 3,977,482 | A | 8/1976 | Reed et al. | |
| 4,418,770 | A | 12/1983 | Lambot | |
| 4,466,497 | A | 8/1984 | Soinski et al. | |
| 4,664,204 | A | 5/1987 | Nenkov et al. | |
| 4,800,969 | A | 1/1989 | Thompson | |
| 4,823,872 | A | 4/1989 | Hopmann | |
| 4,832,138 | A | 5/1989 | Hallez | |
| 4,834,198 | A | 5/1989 | Thompson | |
| 4,930,587 | A | 6/1990 | Young et al. | |
| 5,020,612 | A | 6/1991 | Williams | |
| 5,253,720 | A | 10/1993 | Radford et al. | |
| 5,267,620 | A | 12/1993 | Lee | |
| 5,311,950 | A | 5/1994 | Spektor | |
| 5,325,930 | A | 7/1994 | Harrison | |
| 5,662,182 | A | 9/1997 | McLeod et al. | |
| 5,785,134 | A | 7/1998 | McLeod et al. | |
| 5,799,742 | A | 9/1998 | Soinski et al. | |
| 5,934,393 | A | 8/1999 | Marshall | |
| 5,992,543 | A | 11/1999 | Soinski et al. | |
| D420,013 | S | 2/2000 | Warren et al. | |
| 6,019,181 | A | 2/2000 | Soinski et al. | |
| 6,029,758 | A | 2/2000 | Novacovicci et al. | |
| 6,039,129 | A | 3/2000 | McLeod | |
| 6,059,053 | A | 5/2000 | McLeod | |
| 6,089,335 | A | 7/2000 | Able | |
| 6,371,205 | B1 | 4/2002 | Langan et al. | |
| 6,425,449 | B1 | 7/2002 | Marshall | |
| 6,564,885 | B2 | 5/2003 | Attwater | |
| 6,708,784 | B1 | 3/2004 | Borg | |
| 7,296,638 | B2 | 11/2007 | Beach et al. | |
| 7,314,101 | B2 | 1/2008 | Beach | |
| 7,363,967 | B2 | 4/2008 | Burris, II et al. | |
| 7,730,965 | B2 | 6/2010 | Jordan et al. | |
| D622,293 | S | 8/2010 | Drenth et al. | |
| D622,294 | S | 8/2010 | Drenth et al. | |
| D622,741 | S | 8/2010 | Drenth et al. | |
| D624,564 | S | 9/2010 | Drenth et al. | |
| 7,841,400 | B2 | 11/2010 | Wells et al. | |
| D632,309 | S | 2/2011 | Coyle, Jr. | |
| 7,900,716 | B2 | 3/2011 | Ibrahim et al. | |
| 7,967,085 | B2 | 6/2011 | Drenth | |
| 8,261,857 | B2 | 9/2012 | Able et al. | |
| 8,333,255 | B2 * | 12/2012 | Drenth | 175/247 |
| 8,485,280 | B2 | 7/2013 | Drenth et al. | |
| 2004/0216927 | A1 | 11/2004 | Beach | |
| 2005/0034894 | A1 | 2/2005 | Beach et al. | |
| 2005/0241825 | A1 | 11/2005 | Burris et al. | |
| 2009/0032256 | A1 | 2/2009 | Sun et al. | |
| 2009/0173542 | A1 | 7/2009 | Ibrahim et al. | |
| 2009/0260882 | A1 | 10/2009 | Drenth | |
| 2009/0283328 | A1 | 11/2009 | Drivdahl et al. | |
| 2011/0079435 | A1 | 4/2011 | Drenth et al. | |
| 2011/0079436 | A1 | 4/2011 | Drenth et al. | |
| 2013/0105227 | A1 | 5/2013 | Drenth | |
| 2013/0192901 | A1 | 8/2013 | Londov | |
| 2013/0313024 | A1 | 11/2013 | Drenth et al. | |

FOREIGN PATENT DOCUMENTS

| | | | |
|---|---|---|---|
| AU | 2010303446 | | 10/2010 |
| AU | 2010339878 | | 12/2010 |
| AU | 2010303446 | A1 | 5/2012 |
| AU | 2010339878 | A1 | 7/2012 |
| BR | 11 2012 008034 2 | | 10/2010 |
| BR | 11 2012 014787 0 | | 12/2010 |
| BR | 11 2012 008034 2 | | 4/2011 |
| BR | 11 2012 0147870 | | 7/2011 |
| CA | 2679933 | | 3/2008 |
| CA | 2679933 | A1 | 9/2008 |
| CA | 2776923 | | 10/2010 |
| CA | 2784532 | | 12/2010 |
| CA | 2776923 | A1 | 4/2011 |
| CA | 2784532 | A1 | 7/2011 |
| CL | 2012-00884 | | 10/2010 |
| CL | 2012-01618 | | 12/2010 |
| CL | 88412 | | 4/2011 |
| CL | 2012-01618 | | 7/2011 |
| CN | 200880007004.5 | | 3/2008 |
| CN | 101675205 | A | 3/2010 |
| CN | 201080055434.1 | | 10/2010 |
| CN | 201080057031.0 | | 12/2010 |
| CN | 10278224 | | 4/2011 |
| CN | 102791954 | A | 11/2012 |
| EP | 1757770 | A1 | 2/2007 |
| EP | 08731246.8 | | 3/2008 |
| EP | 2132395 | A1 | 12/2009 |
| EP | 10822658 | | 10/2010 |
| EP | 10842597.6 | | 12/2010 |
| EP | 2486223 | A2 | 8/2012 |
| EP | 2513413 | A2 | 10/2012 |
| GB | 992246 | A | 5/1965 |
| NZ | 599635 | | 10/2010 |
| NZ | 600697 | | 12/2010 |
| NZ | 600697 | | 7/2011 |
| NZ | 599635 | A | 9/2013 |
| PE | 446.2012 | | 10/2010 |
| PE | 823.2012 | | 12/2010 |
| PE | 446.2012 | | 4/2011 |
| PE | 823.2012 | | 7/2011 |
| WO | WO-95/03475 | A1 | 2/1995 |
| WO | WO-03/038232 | A1 | 5/2003 |
| WO | PCT/US2008/055656 | | 3/2008 |
| WO | WO-2008/109522 | A1 | 9/2008 |
| WO | WO-2009/108113 | A1 | 9/2009 |
| WO | WO-2010/096860 | A1 | 9/2010 |
| WO | PCT/US2010/051747 | | 10/2010 |
| WO | PCT/US2010/060744 | | 12/2010 |
| WO | WO-2011/044314 | A2 | 4/2011 |
| WO | WO-2011/084589 | A2 | 7/2011 |
| WO | PCT/US2014/023405 | | 3/2014 |
| ZA | 2009/05921 | | 3/2008 |
| ZA | 2009/05921 | | 9/2008 |
| ZA | 2012/03285 | | 10/2010 |
| ZA | 2012/05268 | | 12/2010 |
| ZA | 2012/03285 | | 4/2011 |
| ZA | 2012/05268 | | 7/2011 |

OTHER PUBLICATIONS

U.S. Appl. No. 61/249,544, filed Oct. 7, 2009, Drenth (Longyear TM, Inc.).

U.S. Appl. No. 61/287,106, filed Dec. 16, 2009, Drenth (Longyear TM, Inc.).

U.S. Appl. No. 14/193,136, filed Feb. 28, 2014, Muntz (Longyear TM, Inc.).

Non-Final Office Action issued by the U.S. Patent & Trademark Office on Jun. 5, 2015 for U.S. Appl. No. 13/943,460, filed Jul. 16, 2013 and published as US-2013-0313024-A1 on Nov. 28, 2013 (Inventor—Drenth, et al. // Applicant—Boart Longyear) (7 pages).

Extended European Search Report issued by the European Patent Office on Jun. 26, 2015 for application EP 08731246.8, filed on Mar. 3, 2008 (Applicant—Boart Longyear // Inventor—Drenth) (5 pages).

U.S. Appl. No. 14/193,136, Muntz et al.

International Preliminary Report on Patentability issued Sep. 8, 2009 for International Patent Application PCT/US2008/055656, which was filed on Mar. 3, 2008 and published as WO 2008/109522 on Sep. 12, 2008 (Inventor—Drenth; Applicant—Boart Longyear) (pp. 1-4).

International Search Report and Written Opinion issued Aug. 8, 2008 for International Patent Application PCT/US2008/055656, which

(56) References Cited

OTHER PUBLICATIONS was filed on Mar. 3, 2008 and published as WO 2008/109522 on Sep. 12, 2008 (Inventor—Drenth; Applicant—Boart Longyear) (pp. 1-5).
Non-Final Office Action issued Aug. 1, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-8).
Amendment "A" and Response to Office Action filed Oct. 27, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-28).
Applicant Initiated Interview Summary issued Nov. 1, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-3).
Final Office Action issued Apr. 5, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-9).
Amendment and Response to Final Office Action filed Jun. 14, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-21).
Applicant Initiated Interview Summary issued Jun. 20, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-3).
Notice of Allowance issued Oct. 3, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-5).
Notice of Allowance issued Nov. 6, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-2).
Issue Notification issued Nov. 28, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-1).
International Preliminary Report on Patentability issued Apr. 11, 2012 for International Patent Application PCT/US2010/051747, which was filed Oct. 7, 2010 and published as WO 2011/044314 on Apr. 14, 2014 (Inventor—Drenth; Applicant—Longyear TM, Inc.) (pp. 1-5).
International Search Report and Written Opinion issued Jun. 10, 2011 for International Patent Application PCT/US2010/051747, which was filed Oct. 7, 2010 and published as WO 2011/044314 on Apr. 14, 2014 (Inventor—Drenth; Applicant—Longyear TM, Inc.) (pp. 1-7).
Preliminary Amendment filed Sep. 27, 2011 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-10).
Restriction Requirement issued Dec. 21, 2012 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-6).
Response to Restriction Requirement filed Jan. 22, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-10).
Non-Final Office Action issued Apr. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-7).
Amendment and Response to Non-Final Office Action filed Jul. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-17).
Final Office Action issued Sep. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-7).
Amendment and Response to Final Office Action filed Jan. 27, 2014 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-14).
Notice of Allowance issued Mar. 31, 2014 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-5).
International Preliminary Report on Patentability issued Jun. 19, 2012 for International Patent Application PCT/US2010/060744, which was filed on Dec. 16, 2010 and published as WO 2011/084589 on Jul. 14, 2011 (Inventor—Drenth; Applicant—Longyear TM, Inc.) (pp. 1-4).
International Search Report and Written Opinion issued Jul. 27, 2011 for International Patent Application PCT/US2010/060744, which was filed on Dec. 16, 2010 and published as WO 2011/084589 on Jul. 14, 2011 (Inventor—Drenth; Applicant—Longyear TM, Inc.) (pp. 1-6).
Non-Final Office Action issued Aug. 6, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-9).
Amendment in Response to Non-Final Office Action filed Nov. 5, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-13).
Final Office Action issued Dec. 21, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-10).
Amendment in Response to Final Office Action filed Feb. 21, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-16).
Supplemental Amendment filed Mar. 1, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-9).
Notice of Allowance, Examiner Interview Summary, and Examiner's Amendment filed Mar. 15, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-8).
Issue Notification issued Jun. 26, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-1).
Notice of Allowance and Examiner's Amendment issued Aug. 1, 2011 for U.S. Appl. No. 29/383,554, filed Jan. 19, 2011 and issued as U.S. Pat. No. D. 649,167 (Inventor—Drenth; Applicant—Longyear TM, Inc.) (pp. 1-7).
Notice of Allowance issued Sep. 20, 2011 for U.S. Appl. No. 29/383,554, filed Jan. 19, 2011 and issued as U.S. Pat. No. D. 649,167 (Inventor—Drenth; Applicant—Longyear TM, Inc.) (pp. 1-7).
Notice of Allowance issued Oct. 17, 2011 for U.S. Appl. No. 29/383,554, filed Jan. 19, 2011 and issued as U.S. Pat. No. D. 649,167 (Inventor—Drenth; Applicant—Longyear TM, Inc.) (pp. 1-2).
Issue Notification issued Nov. 2, 2011 for U.S. Appl. No. 29/383,554, filed Jan. 19, 2011 and issued as U.S. Pat. No. D. 649,167 (Inventor—Drenth; Applicant—Longyear TM, Inc.) (pp. 1-1).
Notice of Allowance and Examiner's Amendment issued Aug. 25, 2011 for U.S. Appl. No. 13/094,581, filed Apr. 26, 2011 and issued as U.S. Pat. No. 8,051,925 on Nov. 8, 2011 (Inventor—Drenth; Applicant—Longyear TM, Inc.) (pp. 1-8).
Issue Notification issued Oct. 19, 2011 for U.S. Appl. No. 13/094,581, filed Apr. 26, 2011 and issued as U.S. Pat. No. 8,051,925 on Nov. 8, 2011 (Inventor—Drenth; Applicant—Longyear TM, Inc.) (pp. 1-1).

(56) References Cited

OTHER PUBLICATIONS

Notice of Allowance issued Aug. 19, 2011 for U.S. Appl. No. 13/094,674, filed Apr. 26, 2011 and issued as U.S. Pat. No. 8,051,924 on Nov. 8, 2011 (Inventor—Drenth; Applicant—Longyear TM, Inc.) (pp. 1-4).
Issue Notification issued Oct. 19, 2011 for U.S. Appl. No. 13/094,674, filed Apr. 26, 2011 and issued as U.S. Pat. No. 8,051,924 on Nov. 8, 2011 (Inventor—Drenth; Applicant—Longyear TM, Inc.) (pp. 1-1).
Notice of Allowance issued Apr. 6, 2011 for U.S. Appl. No. 29/383,340, filed Jan. 14, 2011 and issued as U.S. Pat. No. D. 644,668 on Sep. 6, 2011 (Inventor—Drenth; Applicant—Longyear TM, Inc.) (pp. 1-7).
Supplemental Notice of Allowance issued Jul. 11, 2011 for U.S. Appl. No. 29/383,340, filed Jan. 14, 2011 and issued as U.S. Pat. No. D. 644,668 on Sep. 6, 2011 (Inventor—Drenth; Applicant—Longyear TM, Inc.) (pp. 1-2).
Issue Notification issued Aug. 17, 2011 for U.S. Appl. No. 29/383,340, filed Jan. 14, 2011 and issued as U.S. Pat. No. D. 644,668 on Sep. 6, 2011 (Inventor—Drenth; Applicant—Longyear TM, Inc.) (pp. 1-1).
Notice of Allowance and Examiner's Amendment issued May 26, 2011 for U.S. Appl. No. 29/383,623, filed Jan. 20, 2011 and issued as U.S. Pat. No. D. 647,540 on Oct. 25, 2011 (Inventor—Drenth; Applicant—Longyear TM, Inc.) (pp. 1-7).
Notice of Allowance issued Aug. 4, 2011 for U.S. Appl. No. 29/383,623, filed Jan. 20, 2011 and issued as U.S. Pat. No. D. 647,540 on Oct. 25, 2011 (Inventor—Drenth; Applicant—Longyear TM, Inc.) (pp. 1-7).
Issue Notification issued Oct. 5, 2011 for U.S. Appl. No. 29/383,623, filed Jan. 20, 2011 and issued as U.S. Pat. No. D. 647,540 on Oct. 25, 2011 (Inventor—Drenth; Applicant—Longyear TM, Inc.) (pp. 1-1).
Notice of Allowance issued Apr. 6, 2011 for U.S. Appl. No. 29/383,561, filed Jan. 19, 2011 and issued as U.S. Pat. No. D. 643,859 on Aug. 23, 2011 (Inventor—Drenth; Applicant—Longyear TM, Inc.) (pp. 1-7).
Supplemental Notice of Allowance issued Jul. 11, 2011 for U.S. Appl. No. 29/383,561, filed Jan. 19, 2011 and issued as U.S. Pat. No. D. 643,859 on Aug. 23, 2011 (Inventor—Drenth; Applicant—Longyear TM, Inc.) (pp. 1-2).
Issue Notification issued Aug. 3, 2011 for U.S. Appl. No. 29/383,561, filed Jan. 19, 2011 and issued as U.S. Pat. No. D. 643,859 on Aug. 23, 2011 (Inventor—Drenth; Applicant—Longyear TM, Inc.) (pp. 1-1).
Notice of Allowance issued Apr. 8, 2011 for U.S. Appl. No. 29/383,572, filed Jan. 19, 2011 and issued as U.S. Pat. No. D. 643,443 on Aug. 16, 2011 (Inventor—Drenth; Applicant—Longyear TM, Inc.) (pp. 1-7).
Issue Notification issued Jul. 27, 2011 for U.S. Appl. No. 29/383,572, filed Jan. 19, 2011 and issued as U.S. Pat. No. D. 643,443 on Aug. 16, 2011 (Inventor—Drenth; Applicant—Longyear TM, Inc.) (pp. 1-1).
Non-Final Office Action issued Jan. 6, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-13).
Notice of Allowance issued Feb. 25, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-7).
Issue Notification issued Jun. 28, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-1).
International Search Report and Written Opinion issued Oct. 28, 2009 for International Patent Application PCT/US2009/041435, which was filed on Apr. 22, 2009 and published as WO 2009/132125 on Oct. 29, 2009 (Inventor—Drenth; Applicant—Longyear TM, Inc.) (pp. 1-6).
International Search Report and Written Opinion issued Jul. 27, 2011 for International Patent Application PCT/US2010/060742, which was filed on Dec. 16, 2010 and published as WO 2011/084587 on Jul. 14, 2011 (Inventor—Drenth; Applicant—Longyear TM, Inc.) (pp. 1-6).

* cited by examiner

HIGH PRODUCTIVITY CORE DRILLING SYSTEM

CROSS REFERENCE TO RELATED APPLICATIONS

This patent application is a continuation application of U.S. patent application Ser. No. 12/528,949, filed Aug. 27, 2009, which was filed as a 35 U.S.C. §371 national phase application of International Application No. PCT/US2008/055656, filed Mar. 3, 2008, which claims benefit of U.S. Provisional Patent Application No. 60/892,848, filed Mar. 3, 2007. The contents of each of the above-referenced applications are hereby incorporated by reference in their entirety.

FIELD OF INVENTION

This application generally relates to the field of drilling. In particular, this application discusses a drilling system for drilling core samples that can increase drilling productivity by reducing the amount of time needed to place and retrieve a core sample tube (or sample tube) in a drill string.

BACKGROUND

Drilling core samples (or core sampling) allows observation of subterranean formations within the earth at various depths for many different purposes. For example, by drilling a core sample and testing the retrieved core, scientists can determine what materials, such as petroleum, precious metals, and other desirable materials, are present or are likely to be present at a desired depth. In some cases, core sampling can be used to give a geological timeline of materials and events. As such, core sampling may be used to determine the desirability of further exploration in a particular area.

In order to properly explore an area or even a single site, many core samples may be needed at varying depths. In some cases, core samples may be retrieved from thousands of feet below ground level. In such cases, retrieving a core sample may require the time consuming and costly process of removing the entire drill string (or tripping the drill string out) from the borehole. In other cases, a faster wireline core drilling system may include a core retrieval assembly that travels (or trips in and out of) the drill string by using a wireline cable and hoist.

While wireline systems may be more efficient than retracting and extending the entire drill string, the time to trip the core sample tube in and out of the drill string still often remains a time-consuming portion of the drilling process. The slow rate of the core retrieval assembly of some conventional wireline tripping systems may be cause by several factors. For example, the core retrieval assembly of some wireline systems may include a spring-loaded latching mechanism. Often the latches of such a mechanism may drag against the interior surface of the drill string and, thereby, slow the tripping of the core sample tube in the drill string. Additionally, because drilling fluid and/or ground fluid may be present inside the drill string, the movement of many conventional core retrieval assemblies within the drill string may create a hydraulic pressure that limits the rate at which the core sample tube may be tripped in and out of the borehole.

SUMMARY

This application describes a high productivity core drilling system. The system includes a drill string, an inner core barrel assembly, an outer core barrel assembly, and a retrieval tool that connects the inner core barrel assembly to a wireline cable and hoist. The drill string comprises multiple variable geometry drill rods. The inner core barrel assembly comprises a latching mechanism that can be configured to not drag against the interior surface of the drill string during tripping. In some instances, the latching mechanism may be fluid-driven and contain a detent mechanism that retains the latches in either an engaged or a retracted position. The inner core barrel assembly also comprises high efficiency fluid porting. Accordingly, the drilling system significantly increases productivity and efficiency in core drilling operations by reducing the time required for the inner core barrel assembly to travel through the drill string.

BRIEF DESCRIPTION OF THE FIGURES

To further clarify the advantages and features of the drilling systems described herein, a particular description of the systems will be rendered by reference to specific embodiments illustrated in the drawings. These drawings depict only some illustrative embodiments of the drilling systems and are, therefore, not to be considered as limiting in scope. The same reference numerals in different drawings represent the same element, and thus their descriptions will be omitted. The systems will be described and explained with additional specificity and detail through the use of the accompanying drawings in which.

DETAILED DESCRIPTION

The following description supplies specific details in order to provide a thorough understanding. Nevertheless, the skilled artisan would understand that the drilling systems and drilling systems and associated methods can be implemented and used without employing these specific details. Indeed, the systems and associated methods can be placed into practice by modifying the systems and associated components and methods and can be used in conjunction with any existing apparatus, system, component, and/or technique conventionally used in the industry. For instance, while the drilling systems are described as being used in a downhole drilling operation, they can be modified to be used in an uphole drilling operation. Additionally, while the description below focuses on a drilling system used to trip a core barrel assembly into and out of a drill string, portions of the described system can be used with any suitable downhole or uphole tool, such as a core sample orientation measuring device, a hole direction measuring device, a drill hole deviation device, or any other suitable downhole or uphole object.

Figure 1:
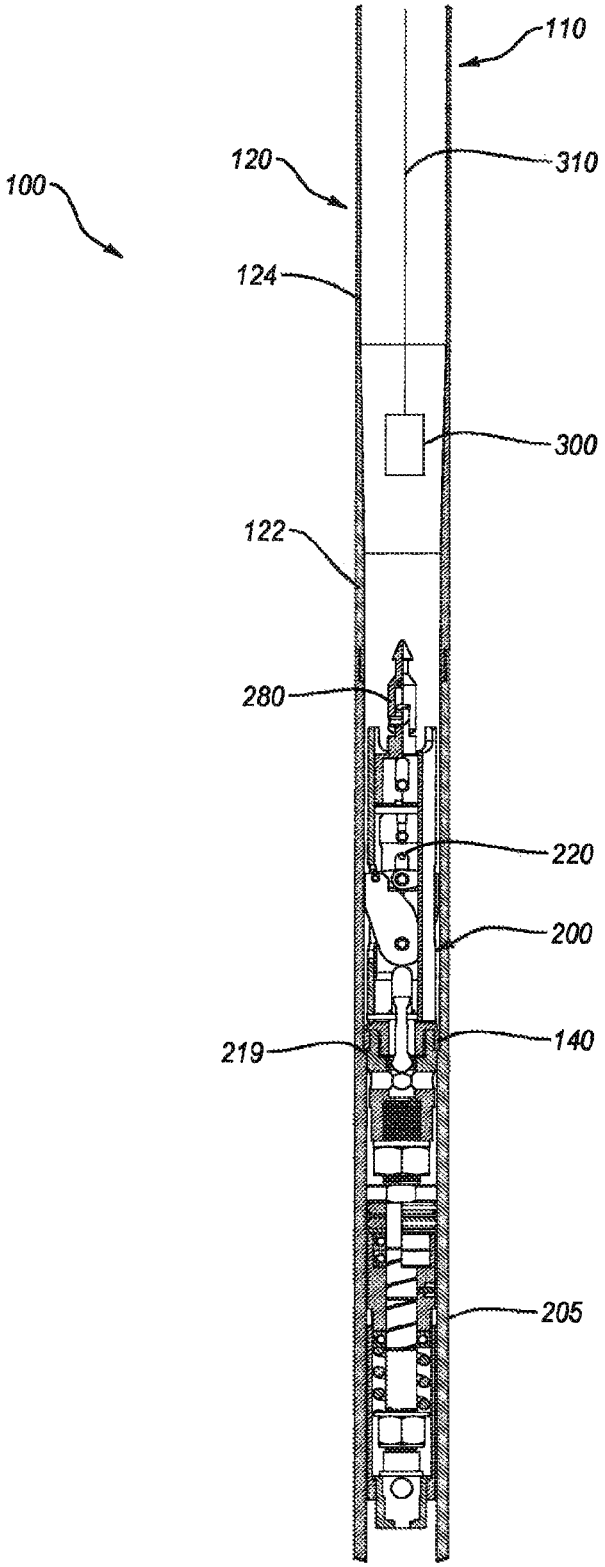
FIG. 1 is a depiction of some embodiments of a core sample drilling system.

FIG. 1 illustrates some embodiments of a drilling system. Although the system may comprise any suitable component, FIG. 1 shows the drilling system 100 may comprise a drill string 110, an inner core barrel assembly comprising an inner core barrel 200, an outer core barrel assembly comprising an outer core barrel 205, and a retrieval tool 300 that is connected to a cable 310.

The drill string may include several sections of tubular drill rod that are connected together to create an elongated, tubular drill string. The drill string may have any suitable characteristic known in the art. For example, FIG. 1 shows a section of drill rod 120 where the drill rod 120 may be of any suitable length, depending on the drilling application.

The drill rod sections may also have any suitable cross-sectional wall thickness. In some embodiments, at least one section of the drill rod in the drill string may have a varying cross-sectional wall thickness. For example, FIG. 1 shows a drill string 110 in which the inner diameter of the drill rod sections 120 varies along the length of the drill rod, while the outer diameter of the sections remains constant. FIG. 1 also shows that the wall thickness at the first end 122 of a section of the drill rod 120 can be thicker than the wall thickness near the middle 124 of that section of the drill rod 120.

The cross-sectional wall thickness of the drill rod may vary any suitable amount. For instance, the cross-sectional wall thickness of the drill rod may be varied to the extent that the drill rod maintains sufficient structural integrity and remains compatible with standard drill rods, wirelines, and/or drilling tools. By way of example, a drill rod with an outer diameter (OD) of about 2.75 inches may have a cross-sectional wall thickness that varies about 15% from its thickest to its thinnest section. In another example, a drill rod with an OD of about 3.5 inches may have a cross-sectional wall thickness that varies about 22% from its thickest to its thinnest section. In yet another example, a drill rod with an OD of about 4.5 inches may have a cross-sectional wall thickness that varies about 30% from its thickest to its thinnest section. Nevertheless, the cross-sectional wall thickness of the drill rods may vary to a greater or lesser extent than in these examples.

The varying cross-sectional wall thickness of the drill rod may serve many purposes. One purpose is that the varying wall thickness may allow the inner core barrel to move through the drill string with less resistance. Often, the drilling fluid and/or ground fluid within the drill string may cause fluid drag and hydraulic resistance to the movement of the inner core barrel. However, the varying inner diameter of drill string 110 may allow drilling fluid or other materials (e.g., drilling gases, drilling muds, debris, air, etc.) contained in the drill string 110 to flow past the inner core barrel in greater volume, and therefore to flow more quickly. For example, fluid may flow past the inner core barrel 200 as the inner barrel passes through the wider sections (e.g., near the middle 124 of a section 120) of the drill string 110 during tripping.

In some embodiments, the drilling system comprises a mechanism for retaining the inner core barrel at a desired distance from the drilling end of the outer core barrel. Although any mechanism suitable for achieving the intended purpose may be used, FIG. 1 shows some embodiments where the retaining mechanism comprises a landing shoulder 140 and a landing ring 219. Specifically, FIG. 1 shows that the landing shoulder 140 comprises an enlarged shoulder portion on the inner core barrel 200. Further, FIG. 1 shows the outer core barrel 205 can comprise a landing ring 219 that mates with the landing shoulder 140.

The landing ring and landing shoulder may have any feature that allows the inner core barrel to "seat" at a desired distance from the drilling end of drill string 110. For example, the landing shoulder may be slightly larger than the outer diameter of the inner core barrel and the core sample tube. In another example, the landing ring may have a smaller inner diameter than the smallest inner diameter of any section of drill rod. Thus, the reduced diameter of the landing ring may be wide enough to allow passage of the sample tube, while being narrow enough to stop and seat the landing shoulder of the inner core barrel in a desired drilling position.

The annular space between the outer perimeter of the landing shoulder and the interior surface of the drill string may be any suitable width. In some instances, the annular space may be thin because a thin annular space may allow the sample tube to have a larger diameter. In other instances, though, because a thin annular space may prevent substantial passage of fluid as the inner core barrel trips through the drill string, the landing shoulder may comprise any suitable feature that allows for increased fluid flow past the landing shoulder. In these other instances, FIG. 28 shows that the landing shoulder 140 may have a plurality of flat surfaces or flats 145 incorporated into its outer perimeter, giving the outer perimeter of the landing shoulder 140 a polygonal appearance. Such flats can increase the average width of the annular space so as to reduce fluid resistance and thereby increase fluid flow-in both tripping directions.

The drill string 110 may be oriented at any angle, including between about 30 and about 90 degrees from a horizontal surface, whether for an up-hole or a down-hole drilling process. Indeed, when the system 100 used with a drilling fluid in a downhole drilling process, a downward angle may help retain some of the drilling fluid at the bottom of a borehole. Additionally, the downward angle may allow the use of a retrieval tool and cable to trip the inner core barrel from the drill string.

Figure 2A:
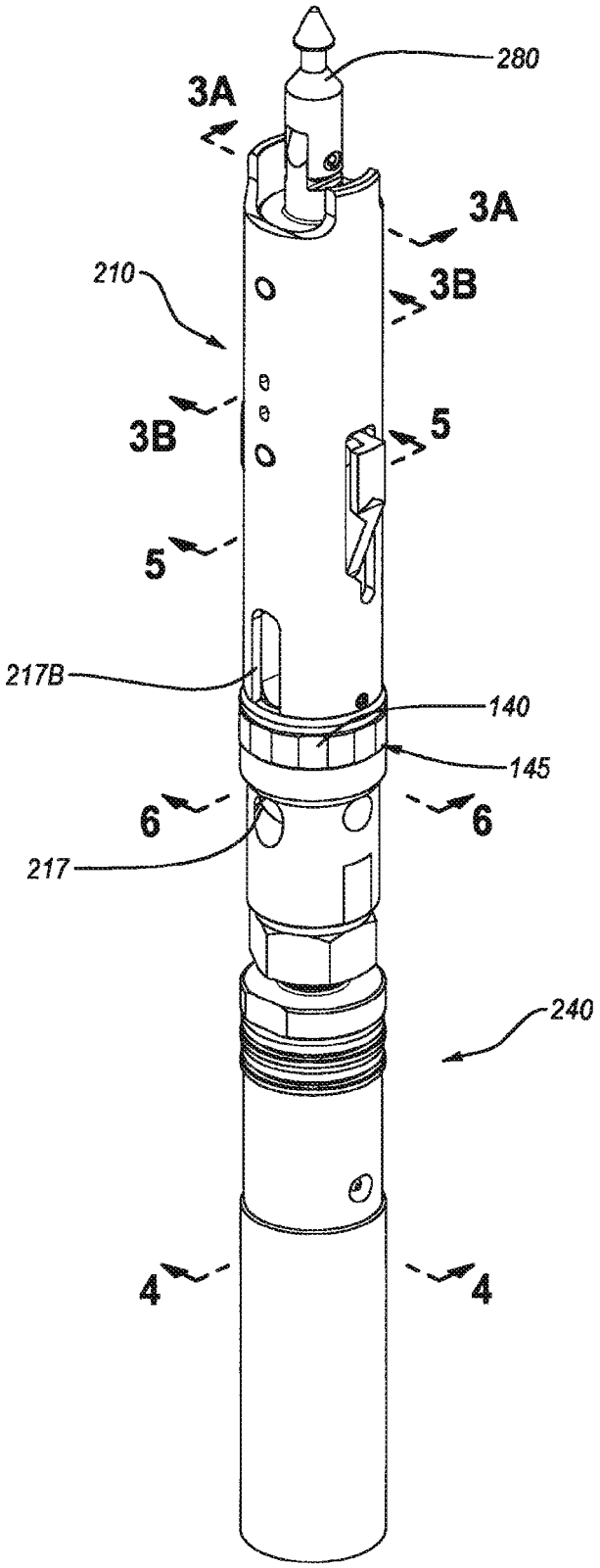
FIGS. 2A and 2B contain different views of some embodiments of an inner core barrel assembly.

The inner core barrel may have any characteristic or component that allows it to connect a downhole object (e.g., a sample tube) with retrieval tool so that the downhole object can be tripped in or out of the drill string. For example, FIG. 2A shows the inner core barrel 200 may include a retrieval point 280, an upper core barrel assembly comprising an upper core barrel 210 (or in other words a core barrel head assembly), and a lower core barrel assembly comprising a lower core barrel 240.

The retrieval point 280 of the inner core barrel 200 may have any characteristic that allows it to be selectively attached to any retrieval tool, such as an overshot assembly and a wireline hoist. For example, FIG. 2A shows the retrieval point 280 may be shaped like a spear point so as to aid the retrieval tool to correctly align and couple with the retrieval tool. In another example, the retrieval point 280 may be pivotally attached to the upper core barrel so as to pivot in one plane with a plurality of detent positions. By way of illustration, FIG. 2B shows the retrieval point 280 may be pivotally attached to a spearhead base 285 of a retrieval tool via a pin 290 so a spring-loaded detent plunger 292 can interact with a corresponding part on the spearhead base 285.

Figure 3A:
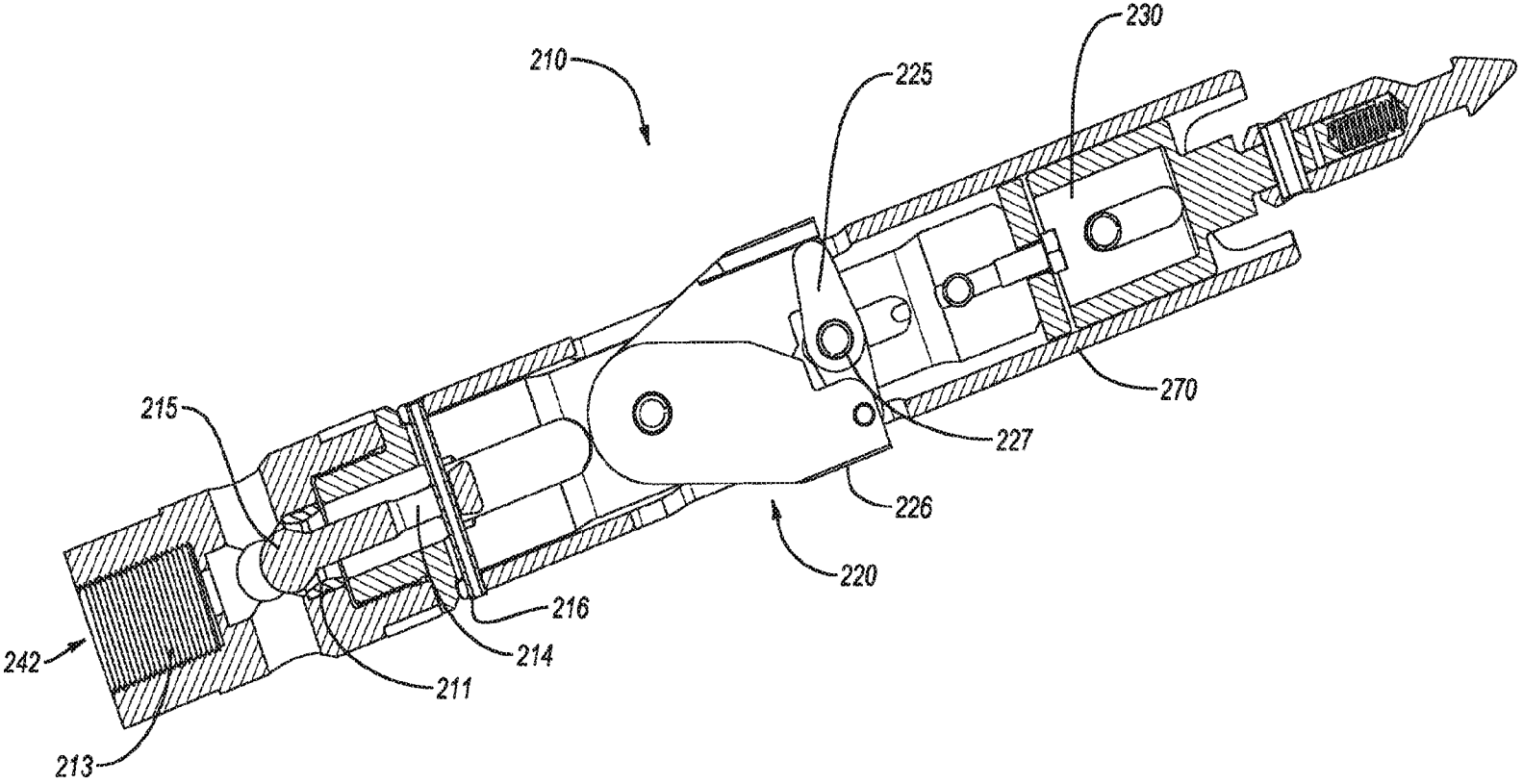
FIGS. 3A and 3B depict cross-sectional views of some embodiments of one portion of a core sample drilling system.
Figure 3B:
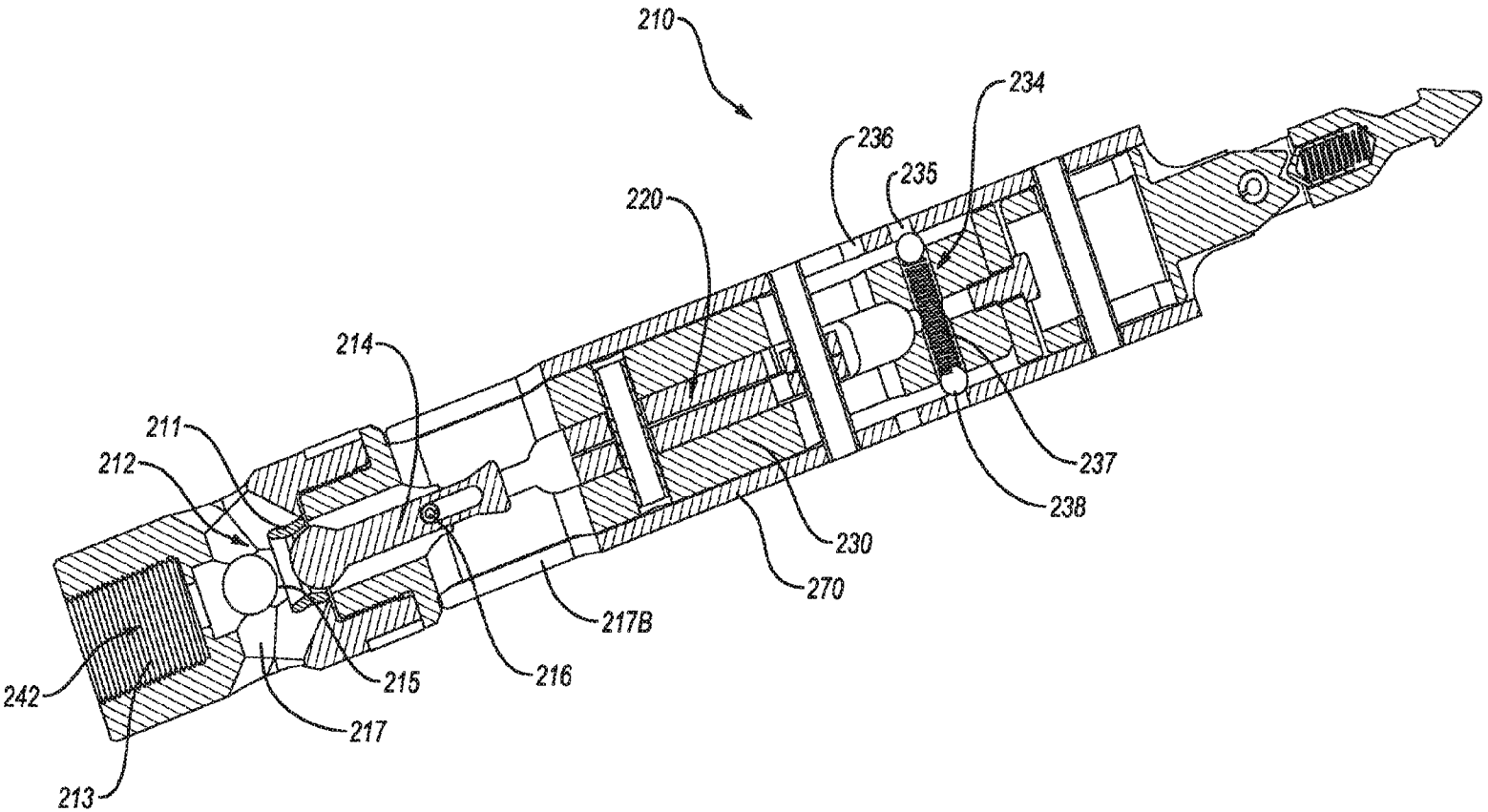

The upper core barrel 210 may have any suitable component or characteristic that allows the core sample tube to be positioned for core sample collection and to be tripped out of the drill string. For example, FIGS. 3A and 3B show the upper core barrel 210 may include an inner sub-assembly 230 (or in other words an inner member), an outer sub-assembly 270 (or in other words an outer sleeve), a fluid control valve 212, a latching mechanism 220, and a connection member 213 for connecting to the lower core barrel.

The inner sub-assembly 230 and the outer sub-assembly 270 may have any component or characteristic suitable for use in an inner core barrel. For instance, FIG. 2B shows some embodiments where the inner and the outer sub-assembly may be configured to allow the inner sub-assembly 230 to be coupled to and move axially (or move back and/or forth in the drilling direction) with respect to the outer sub-assembly 270.

Figure 2B:
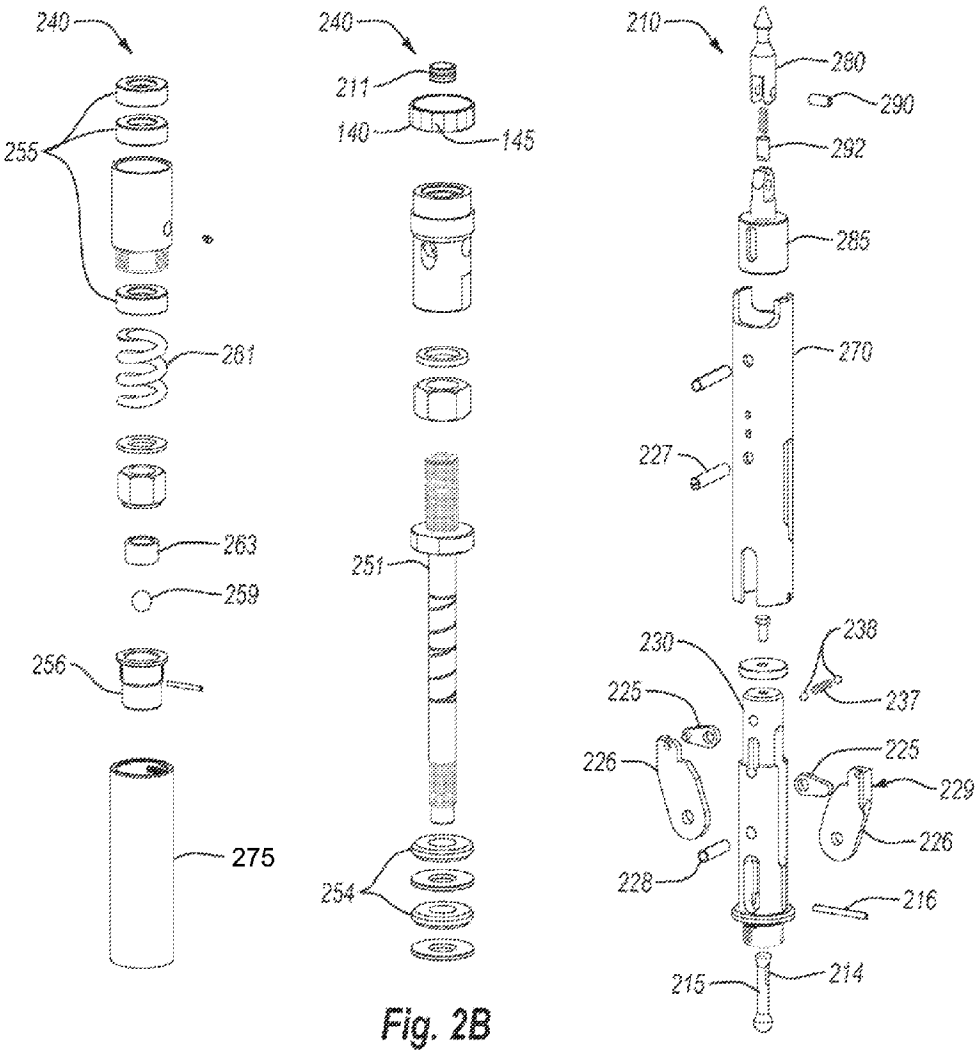

FIG. 2B also shows that the inner sub-assembly 230 can be connected to the outer sub-assembly 270 via a pin 227 that passes through a slot 232 in the inner sub-assembly 230 in a manner that allows the inner sub-assembly 230 to move axially with respect to the outer sub-assembly 270 for a distance corresponding to the length of the slot 232.

In some embodiments, the upper core barrel comprises a fluid control valve. Such a valve may serve many functions, including providing control over the amount of drilling fluid that passes through the inner core barrel during tripping and/or drilling. Another function can include partially controlling the latching mechanism, as described herein.

The fluid control valve may have any characteristic or component consistent with these functions. For example, FIGS. 2B and 3A show that the fluid control valve 212 can comprise a fluid control valve member 215 and a valve ring 211. The valve member 215 may be coupled to the outer sub-assembly 270 by any known connector, such as pin 216. The pin 216 may travel in a slot 214 of the valve member 215 so that the valve member 215 can move axially with respect to both the inner sub-assembly 230 and the outer sub-assembly 270. The movement of the valve member 215 relative to the inner sub-assembly 230 allows the fluid control valve 212 to be selectively opened or closed by interacting with the valve ring 211. For example, FIG. 3A shows the fluid control valve 212 in an open position where the valve member 215 has traveled past the valve ring 211, to one extent of the slot 214. Conversely, FIG. 3B shows the fluid control valve 212 in an open position where the valve member 215 is retracted to another extent of the slot 214. The fluid control valve in FIG. 3B is in a position ready to be inserted into the drill string where it can allow fluid to flow from the lower core barrel to the upper core barrel.

In some embodiments, the upper core barrel 210 can contain an inner channel 242 that allows a portion of the drilling fluid to pass through the upper core barrel 210. While fluid ports may be provided along the length of the inner core barrel 200 as desired, FIGS. 2A and 3B show fluid ports 217 and 217B that provides fluid communication between the inner channel 242 and the exterior of inner core barrel 200. The fluid ports 217 and 217B may be designed to be efficient and to allow fluid to flow through and past portions of inner core barrel 200 where fluid flow may be limited by geometry or by features and aspects of inner core barrel 200. Similarly, any additional fluid flow features may be incorporated as desired, i.e., flats machined into portions of inner core barrel.

FIG. 3A shows some embodiments where the fluid control valve 212 is located within the inner channel 242. In such embodiments, a drilling fluid supply pump (not shown) may be engaged to deliver fluid flow and pressure to generate fluid drag across the valve member 215 so as to push the valve member 215 to engage and/or move past the valve ring 211.

In some embodiments, the upper core barrel also comprises a latching mechanism that can retain the core sample tube in a desired position with respect to the outer core barrel while the core sample tube is filled. In order to not hinder the movement of the inner core barrel within the drill string, the latching mechanism can be configured so that the latches do not drag against the drill string's interior surface. Accordingly, this non-dragging latching mechanism can be any latching mechanism that allows it to perform this retaining function without dragging against the interior surface of the drill string during tripping. For instance, the latching mechanism can comprise a fluid-driven latching mechanism, a gravity-actuated latching mechanism, a pressure-activated latching mechanism, a contact-actuated mechanism, or a magnetic-actuated latching mechanism. Consequently, in some embodiments, the latching mechanism can be actuated by electronic or magnetic sub-systems, by valve works driven by hydraulic differences above and/or below the latching mechanism, or by another suitable actuating mechanism.

The latching mechanism may also comprise any component or characteristic that allows it to perform its intended purposes. For example, the latching mechanism may comprise any number of latch arms, latch rollers, latch balls, multi-component linkages, or any mechanism configured to move the latching mechanism into the engaged position when the landing shoulder of the inner core barrel is seated against the landing ring.

By way of non-limiting example, FIGS. 2B and 3A show some embodiments of the latching mechanism 220 comprising at least one pivot member 225 that is pivotally coupled to the outer sub-assembly 270 by a connector, such as pin 227. FIGS. 2B and 3A also show the latching mechanism 220 can include at least one latch arm 226 that is coupled to the inner sub-assembly 230 by a connector (such as pin 228) so that the latch arm or arms 226 may be retracted or extended from the outer sub-assembly 270. FIG. 2B shows the latch arm 226 can comprise an engagement flange 229, or a surface configured to frictionally engage the interior surface of the drill string when the latching mechanism is in an engaged position. For example, FIG. 3A shows that when in an engaged position, the latch arms 226 may extend out of and/or away from the outer sub-assembly 270. Conversely, when in a retracted position (as shown in FIG. 5C), the latch arms 226 may not extend outside the outer diameter of the outer sub-assembly 270.

In some embodiments, the latching mechanism may also comprise a detent mechanism that helps maintain the latching mechanism in an engaged or retracted position. The detent mechanism may help hold the latch arms in contact with the interior surface of the drill string during drilling. The detent mechanism may also help the latch arms to stay retracted so as to not contact and drag against the interior surface of the drill string during any tripping action.

The detent mechanism may contain any feature that allows the mechanism to have a plurality of detent positions. FIG. 3B shows some embodiments where the detent mechanism 234 comprises a spring 237 with a ball 238 at each end. The detent mechanism 234 is located in the inner sub-assembly 230 and cooperates with detent positions 235 and 236 in the outer sub-assembly 270 to hold the latching mechanism in either an engaged position, as when the detent mechanism 234 is in an engaged detent position 235, or a retracted position, as when the detent mechanism 234 is in a retracted detent position 236.

In some preferred embodiments, the latching mechanism may cooperate with the fluid control valve so as to be a fluid-driven latching mechanism. Accordingly, the fluid control valve 212 can operate in conjunction with the latching mechanism 220 so as to allow the inner core barrel 200 to be quickly and efficiently tripped in and out of the drill string 110. The latching mechanism and the fluid control valve may be operatively connected in any suitable manner that allows the fluid control valve to move the latching mechanism to the engaged position as shown in FIGS. 5A-6C, as described in detail below.

Figure 4:
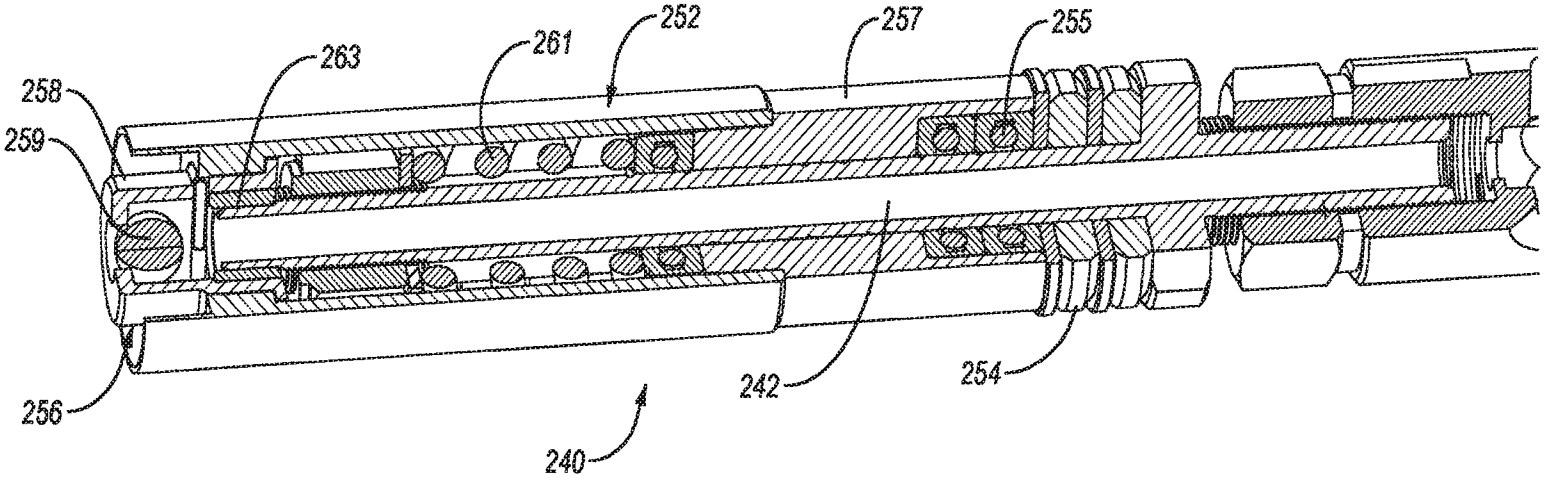
FIG. 4 is a cross-sectional view of some embodiments of a portion of a core sample drilling system.

FIG. 4 illustrates some embodiments of the lower core barrel 240. The lower core barrel 240 may include any component or characteristic suitable for use with an inner core barrel. In some embodiments, as shown in FIG. 4, the lower core barrel may comprise at least one inner channel 242, check valve 256, core breaking apparatus 252, bearing assembly 255, compression washer 254, and core sample tube connection 258.

FIG. 4 shows that the inner channel 242 can extend from the upper core barrel through the lower core barrel 240. Among other things, the inner channel can increase productivity by allowing fluid to flow directly through the lower core barrel. The inner channel may have any feature that allows fluid to flow through it. For example, FIG. 2B shows the inner channel 242 may comprise a hollow spindle 251 that runs from the upper core barrel 210 to the lower core barrel 240.

According to some embodiments, the lower core barrel comprises a check valve 256 that allows fluid to flow from the core sample tube to the inner channel, but does not allow fluid to flow from the inner channel to the core sample tube. Accordingly, the check valve may allow fluid to pass into the inner channel and then through the inner core barrel when the inner core barrel is being tripped into the drill string and when core sample tube is empty. In this manner, fluid resistance can be lessened so the inner core barrel can be tripped into the drill string faster and more easily. On the other hand, when the inner core barrel is tripped out of the drill string, the check valve can prevent fluid from pressing down on a core sample contained in core sample tube. Accordingly, the check valve may prevent the sample from being dislodged or lost. And when the check valve prevents fluid from passing through the lower core barrel and into the core sample tube, the fluid may be forced to flow around the outside of the core sample tube and the lower core barrel. Although any unidirectional valve may serve as the check valve, FIG. 4 shows some embodiments where the check valve 256 comprises a ball valve 259.

In some embodiments, the lower core barrel 240 may comprise a bearing assembly that allows the core sample tube to remain stationary while the upper core barrel and drill string rotate. The lower core barrel may comprise any bearing assembly that operates in this manner. In the embodiments shown in FIG. 4, the bearing assembly 255 comprises ball bearings that allow an outer portion 257 of the lower core barrel 240 to rotate with the drill string during drilling operations, while maintaining the core sample tube in a fixed rotational position with respect to the core sample.

The lower core barrel may be connected to the core sample tube in any suitable manner. FIG. 4 shows some embodiments where the lower core barrel 240 is configured to be threadingly connected to the inner tube cap 275 (shown in FIG. 2B) and/or the core sample tube by a core sample tube connection 258, which is coupled to the bearing assembly 255.

FIG. 4 also shows some embodiments where the lower core barrel 240 contains a core breaking apparatus. The core breaking apparatus may be used to apply a moment to the core sample and, thereby, cause the core sample to break at or near the drill head (not shown) so the core sample can be retrieved in the core sample tube. While the lower core barrel 240 may comprise any core breaking apparatus, FIG. 4 shows some embodiments where the core breaking apparatus 252 comprises a spring 261 and a bushing 263 that can allow relative movement of the core sample tube and the lower core barrel 240.

In some embodiments, the lower core barrel may also comprise one or more compression washers that restrict the flow of drilling fluid once the core sample tube is full, or once a core sample is jammed in the core sample tube. The compression washers (254 shown in FIG. 4) can be axially compressed when the drill string and the upper core barrel press in the drilling direction, but the core sample tube does not move axially because the sample tube is full or otherwise prevented from moving downwardly with the drill string. This axial compression causes the washers to increase in diameter so as to reduce, and eventually eliminate, any space between the interior surface of the drill string and the outer perimeter of the washers. As the washers reduce this space, they can cause an increase in drilling fluid pressure. This increase in drilling fluid pressure may function to notify an operator of the need to retrieve the core sample and/or the inner core barrel.

Figure 5A:
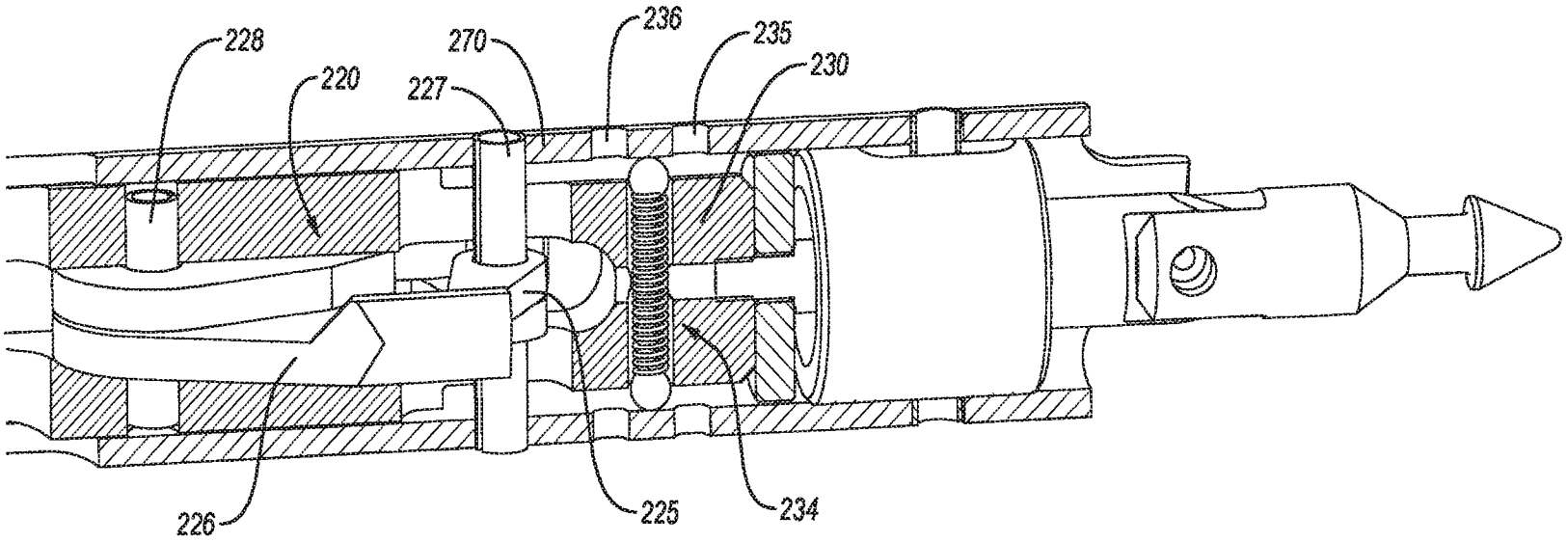
FIGS. 5A-5C are cross-sectional views of some embodiments of a portion of a core sample drilling system in different modes of performance.
Figure 5B:
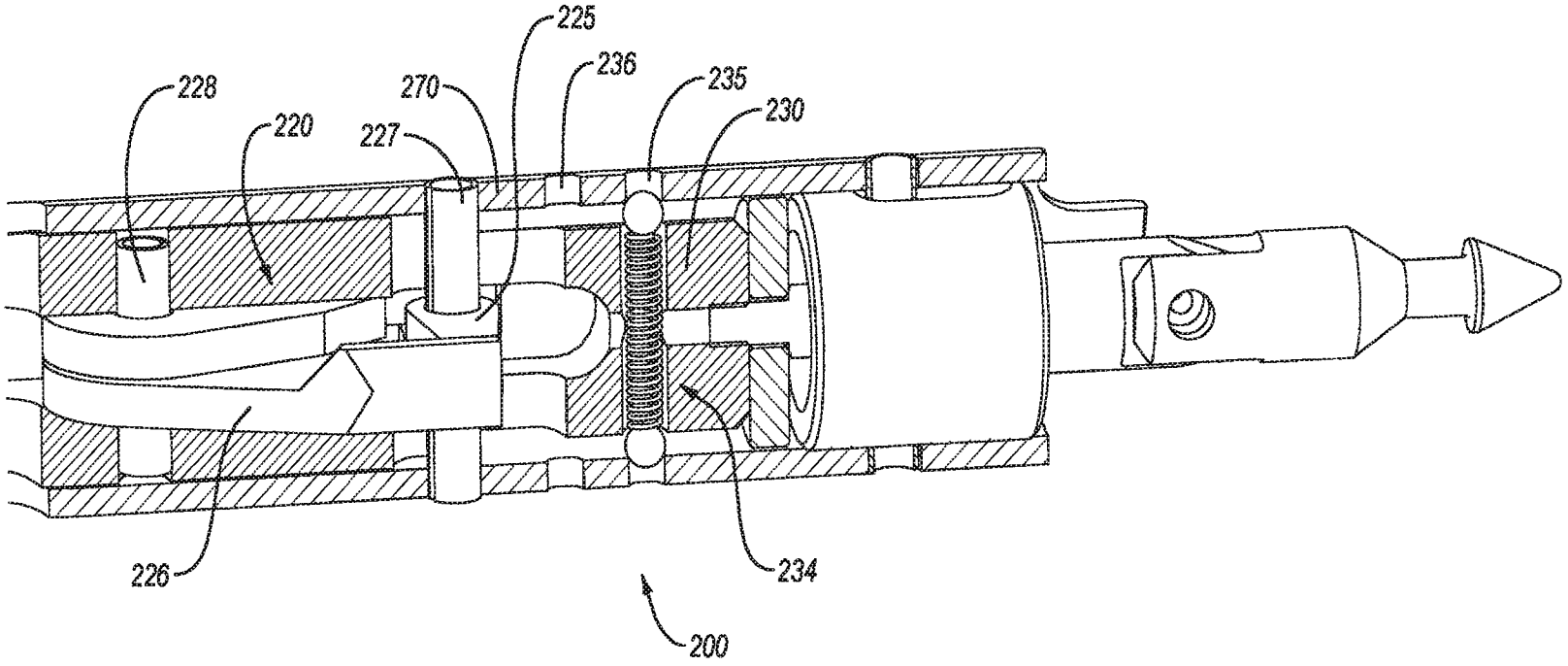
Figure 5C:
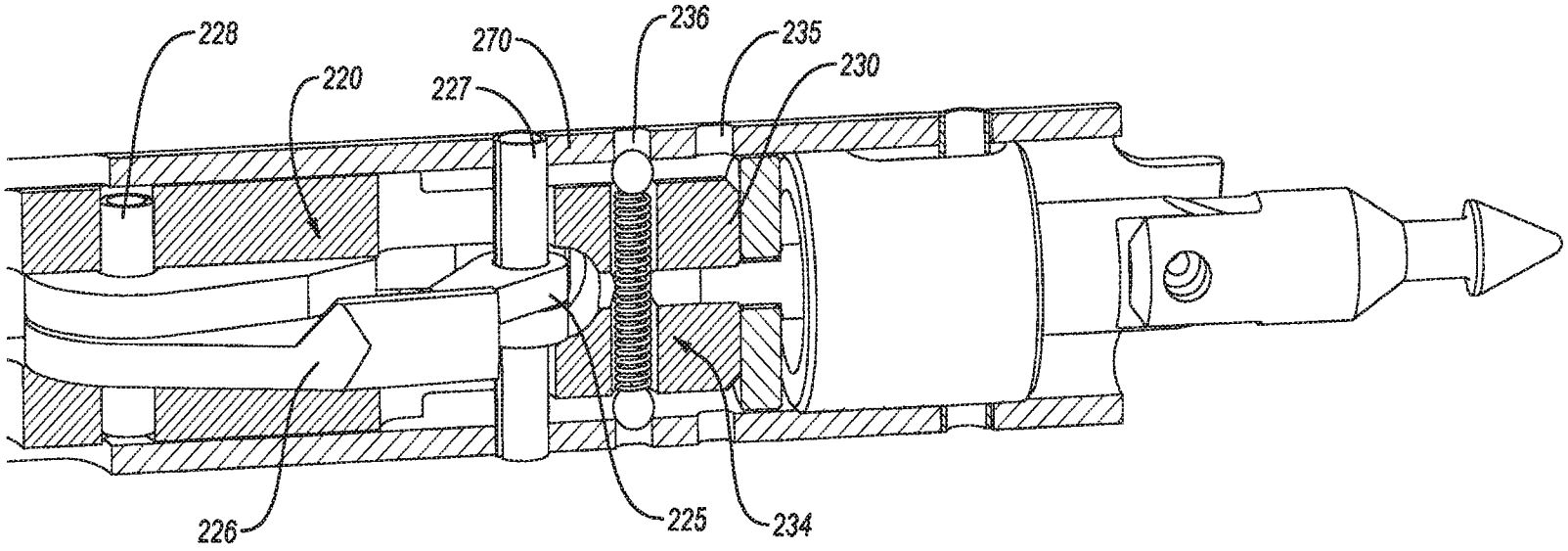

FIGS. 5A-6C illustrate some examples of the function of the inner core barrel 200 during tripping and drilling and the function of some embodiments of both the detent mechanism 234 and the fluid-driven latching mechanism 220. FIG. 5A depicts the detent mechanism 234 in an intermediary position, as may be the case when the latching mechanism 220 is manually placed in a retracted position in preparation for insertion into the drill string. FIG. 5B shows that when the latch arms 226 are in an engaged position, the pivot member 225 is extended to force the latch arms 226 to remain outward (as also shown in FIG. 3A). On the contrary, when the latch arms 226 are in a retracted position, as shown in FIG. 5C, the pivot member 225 can be rotated such that the latch arms 226 may be retracted into the upper core barrel 210.

As described above, the inner sub-assembly 230 can move axially with respect to the outer sub-assembly 270. In some embodiments, this movement can cause the latching mechanism to move between the retracted and the engaged positions as illustrated in FIGS. 5A-5C, where the movement of the inner sub-assembly 230 with respect to the outer sub-assembly 270 may change the position of the latch arms 226. The pin 228 holding the latch arms 226 can be connected only to the inner sub-assembly 230 and the pin 227 holding the pivot member 225 can be connected to the outer sub-assembly 270. Thus, when the outer sub-assembly 270 moves axially with respect to the inner sub-assembly 230 so as to cover less of the of the inner sub-assembly 230, the distance between the two pins (pin 228 and pin 227) can increase and the pivot member 225 can rotate. As a result, the latch arms 226 may partially or completely move into the outer sub-assembly 270 and the detent mechanism 234 can move from the engaged detent position 235 to the retracted detent position 236 (as shown in FIG. 5C). On the contrary, when the outer sub-assembly 270 moves axially so as to cover more of the inner sub-assembly 230, the distance between the two pins (pins 228 and 227) can decrease and the latch arms 226 may be forced out of the outer sub-assembly 270 into an engaged position (as shown in FIG. 5B).

Figure 6A:
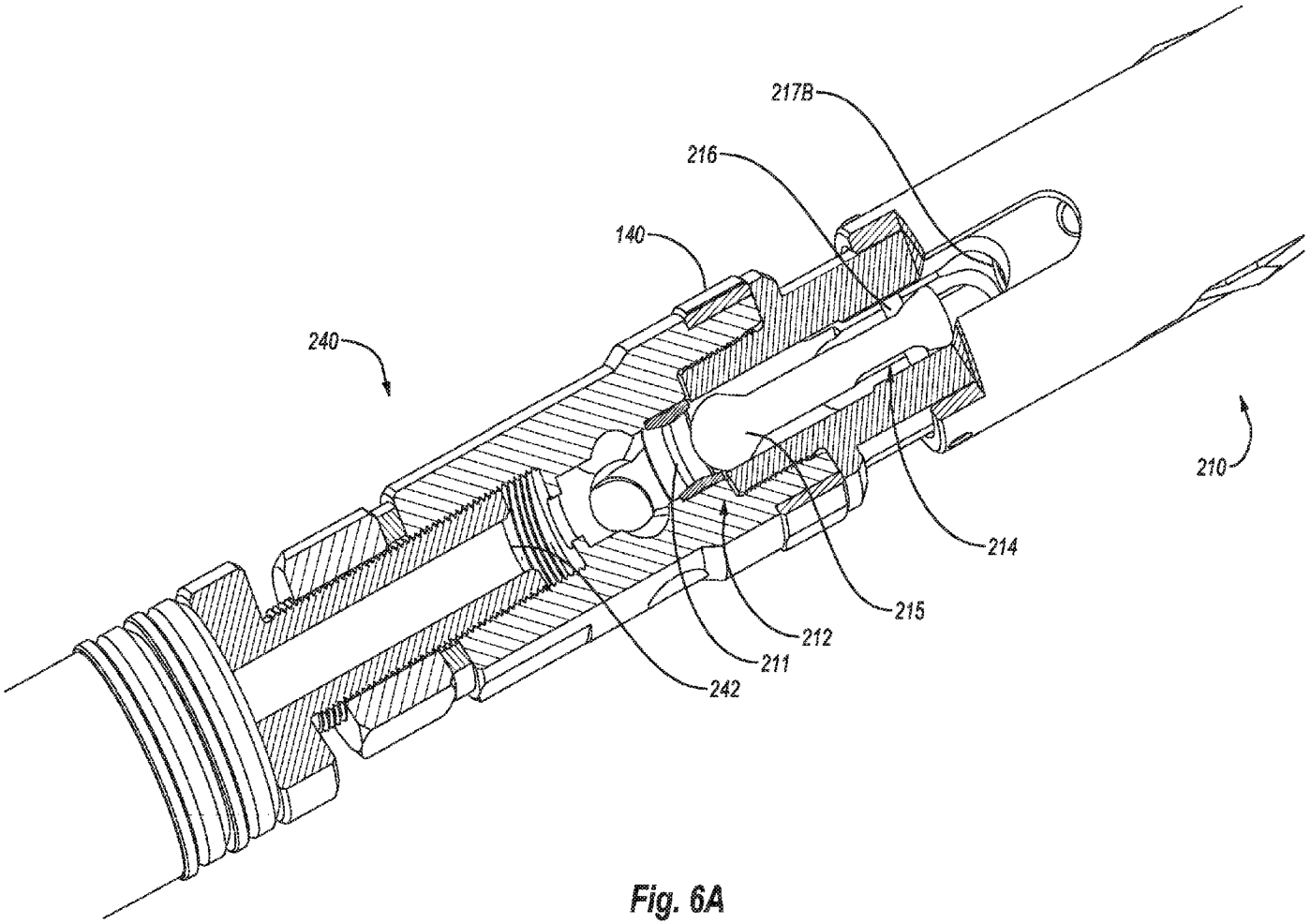
FIGS. 6A-6C are cross-sectional views of some embodiments of a portion of a core sample drilling system in different modes of performance.
Figure 6B:
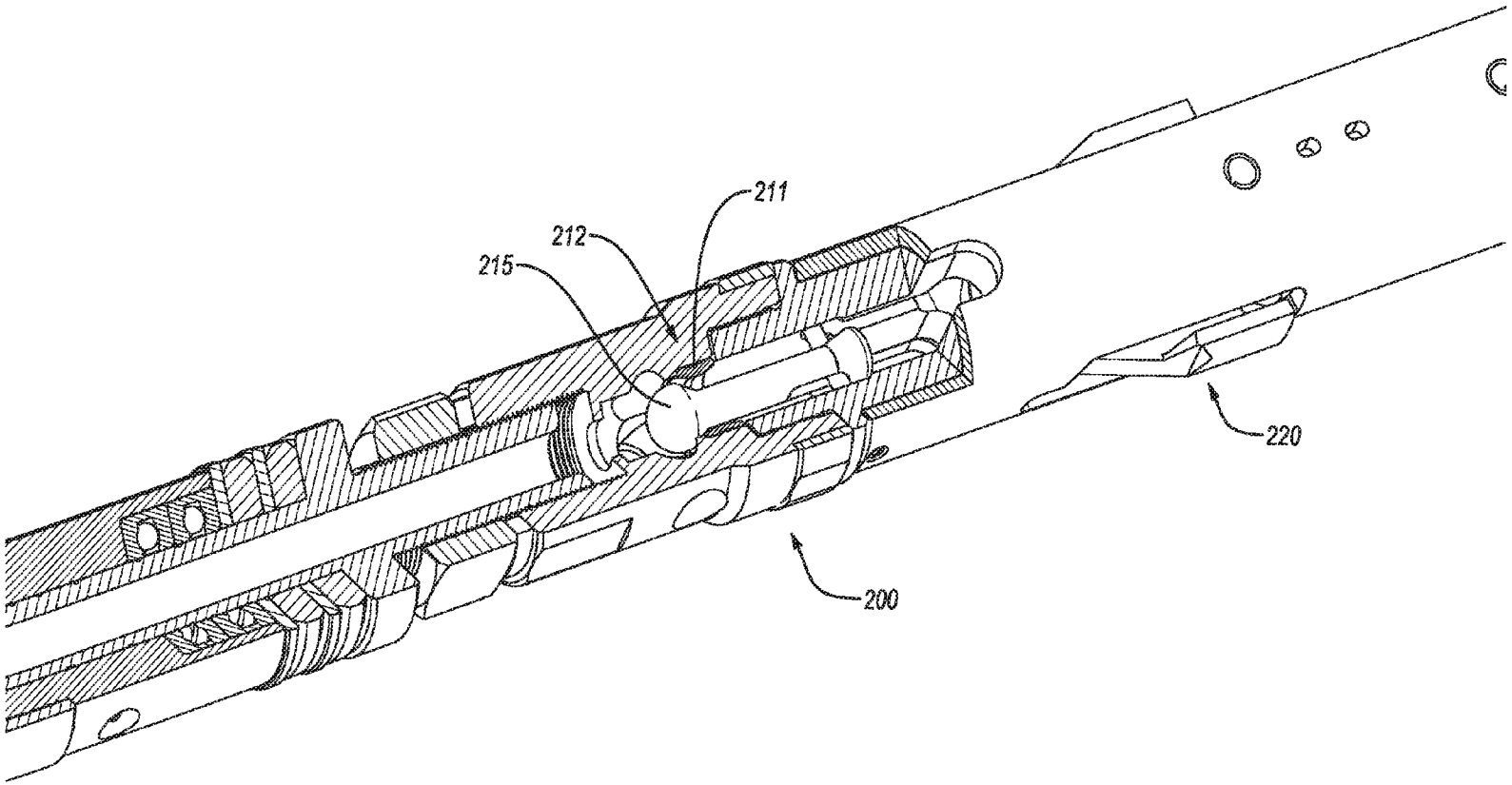
Figure 6C:
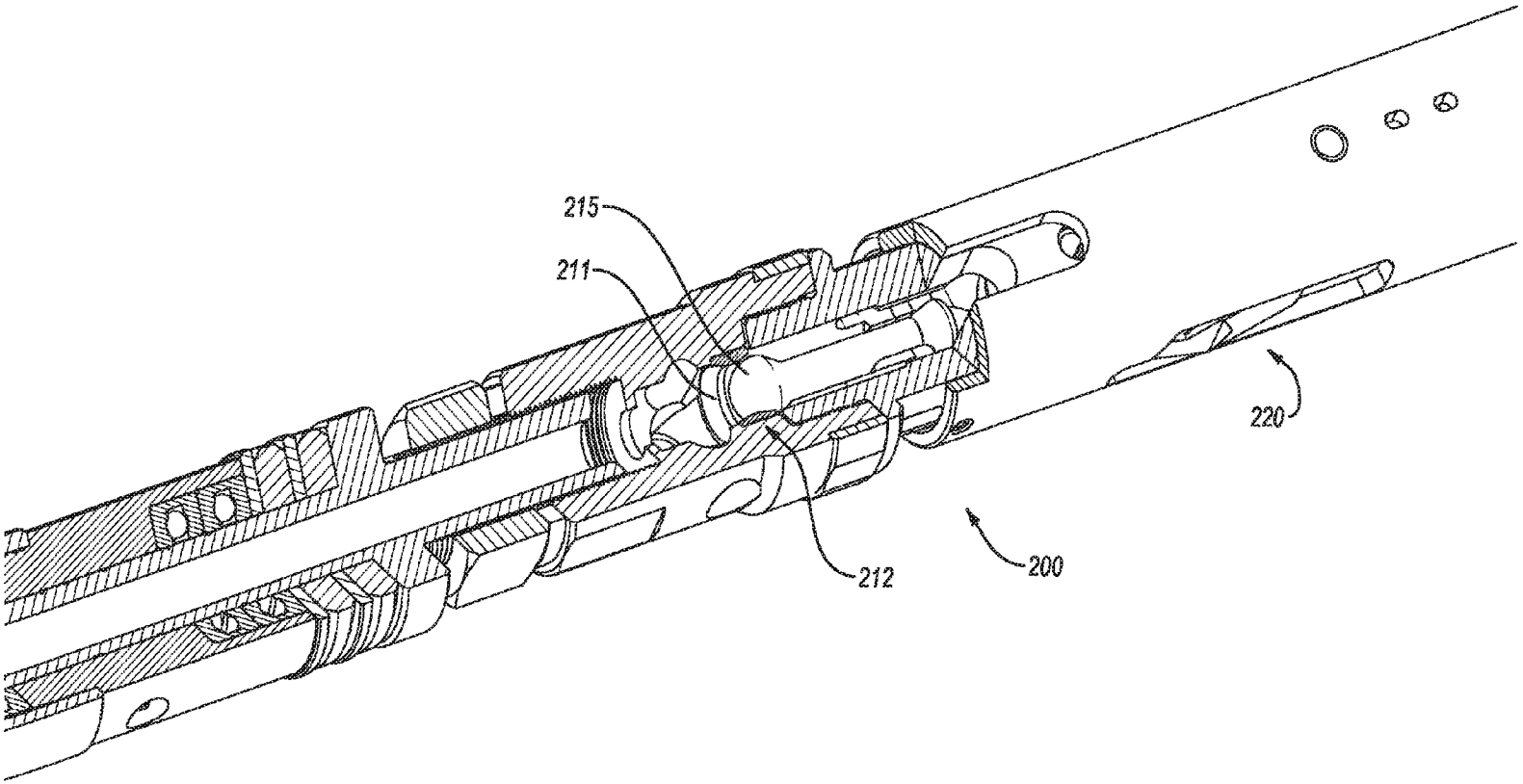

FIGS. 6A-6C shows some examples of how the fluid control valve 212 can function. FIG. 6A shows the fluid control valve 212 in an open position so that fluid can flow from the lower core barrel 240, through the inner channel 242, past the fluid ring 211, past the fluid control valve 212, and through the fluid ports 217B to the exterior of the inner core barrel 200. With the fluid control valve 212 in an open position, the latching mechanism 220 can be in a retracted position and ready for insertion into the drill string. In this open position shown in FIG. 6A, the fluid can flow from the lower core barrel 240 to the upper core barrel 210, but fluid pressure forces the valve member 215 towards the fluid ring 211 and causes the fluid control valve to press against the fluid ring 211 and prevent fluid flow.

When the landing shoulder of the inner core barrel reaches the landing ring in the drill string, the inner core barrel can be prevented from moving closer to the drilling end of the outer core barrel. Because the landing shoulder can be in close tolerance with the interior surface of the drill string, drilling fluid may be substantially prevented from flowing around the landing shoulder 140. Instead, the drilling fluid can travel through the inner core barrel 200 (e.g., via fluid ports 217B and the inner channel 242). Thus, the fluid can flow and press against the valve member 215. The slot 214 may then allow the valve member 215 to move axially so as to press into and past the fluid ring 211 until the slot 214 engages pin 216. FIGS. 6B and 3A show that at this point, the fluid control valve 212 may again be in an open position below the fluid ring 211. Where the detent mechanism 234 is in an intermediary position (as shown in FIG. 5A), the inner sub-assembly 230 may be moved when the valve member 215 pulls on the pin 216 that is attached to the inner sub-assembly 230. Thus, fluid pressure can cause the valve member 215 to move past the fluid ring 211 and, thereby, move the inner sub-assembly 230 and the detent mechanism 234 so that the latching mechanism 220 moves into and is retained in the engaged position.

FIGS. 5B and 6B illustrate some embodiments of the inner core barrel 200 with the latching mechanism 220 in the engaged position (i.e., ready for drilling). As shown in FIG. 5B, the detent mechanism 234 can be held in the engaged detent position 235. And as shown in FIG. 6B, during drilling the fluid control valve 212 can be held in an open position with the valve member 215 pushed below the fluid ring 211 by the fluid pressure.

Once the core sample tube is filled as desired, the drilling process may be stopped and the core sample can be tripped out of the drill string. To retrieve the core sample, the retrieval point 280 is pulled towards earth's surface by a retrieval tool 300 connected to a wireline cable 310 and hoist (not shown). The pulling force on the retrieval point 280 (and hence the pulling force on the outer sub-assembly 270) may be resisted by the engaged latching mechanism (e.g., mechanism 220) and the weight of the core sample in the core sample tube. These resisting forces may cause the inner sub-assembly 230 to move with respect to the outer sub-assembly 270 so that the detent mechanism 234 moves from the engaged detent position 235 (as shown in FIG. 5B) to the retracted detent position 236 (as shown in FIG. 5C). The movement of the inner sub-assembly 230 forces the pin 216 to move away from the fluid ring 211. As the slot 214 in the valve member 215 is caught by the pin 216, the fluid control valve 212 moves into a closed position where the valve member 215 is seated in the fluid ring 211 (as shown in FIG. 6C). And as the inner core barrel stripped out of the drill string, downward fluid pressure may prevent the fluid control valve 212 from opening upwardly.

As mentioned above, the movement of the inner sub-assembly 230 may force the latching mechanism 220 into a retracted position, as shown in FIG. 6C. In the retracted position, the latching mechanism 220 does not drag or otherwise resist extraction of the inner core barrel 200 from the drill string. Thus, the fluid driven latching mechanism greatly reduces the time required to retrieve a core sample. Once the inner core barrel 200 is tripped out of the drill string and the core sample is removed, the inner core barrel can be reset, as illustrated by FIGS. 5A and 6A, to be placed into drill string to retrieve another core sample.

In some variations of the described system, one or more of the various components of the inner core barrel may be incorporated with a variety of other downhole or uphole tools and/or objects. For instance, some form of the non-dragging latching mechanism, such as the fluid-driven latching mechanism with the detent mechanism, may be incorporated with a ground or hole measuring instrument or a hole conditioning mechanism. By way of example, any in-hole measuring instrument assembly may comprise a fluid-driven latching mechanism, such as that previously described. In this example, the assembly may be tripped into the drill string and stopped at a desired position (e.g., at the landing ring). Then, as fluid applies pressure to the fluid control valve in the assembly, the latching mechanism can be moved to the engaged position in a manner similar to that described above.

The embodiments described in connection with this disclosure are intended to be illustrative only and non-limiting. The skilled artisan will recognize many diverse and varied embodiments and implementations consistent with this disclosure. Accordingly, the appended claims are not to be limited by particular details set forth in the above description, as many apparent variations thereof are possible without departing from the spirit or scope thereof.

What is claimed is:

1. A core barrel head assembly configured to be tripped through a drill string having an outer core barrel defining a landing ring, comprising:

an inner member;

an outer sleeve moveably coupled to the inner member; and a non-dragging latching mechanism configured to be tripped into a drill string without dragging against an interior surface of the drill string, wherein the latching mechanism is configured to selectively move between an engaged position and a retracted position as the outer sleeve moves axially relative to the inner member wherein when in the engaged position, at least a portion of the latching mechanism extends outward of the outer sleeve, and wherein the non-dragging latching mechanism comprises a detent mechanism that is positioned within the inner member and moveable to a retracted detent position to selectively lock the latching mechanism in the retracted position, wherein in the retracted detent position, the detent mechanism extends outwardly of the inner member to mechanically engage the outer sleeve and prevent axial movement of the outer sleeve relative to the inner member during tripping of the core barrel head assembly.

2. The core barrel head assembly of claim 1, wherein the latching mechanism comprises a fluid-driven latching mechanism.

3. The core barrel head assembly of claim 1, wherein the detent mechanism is moveable to an engaged detent position to selectively retain the latching mechanism in the engaged position when the core barrel head assembly is not tripping through the drill string.

4. The core barrel head assembly of claim 1, further comprising a retrieval portion coupled to the outer sleeve.

5. The core barrel head assembly of claim 4, wherein the latching mechanism is configured to be moved into the engaged position by fluid pressure applied to the inner member and configured to be moved to the retracted position by a force on the retrieval portion.

6. The core barrel head assembly of claim 1, wherein the latching mechanism comprises one or more of latch arms, latch balls, latch rollers, or multi-component linkages.

7. A core barrel head assembly configured to be tripped through a drill string to an outer core barrel having a landing ring, comprising:

an inner member;

an outer sleeve moveably coupled to the inner member, the outer sleeve having an outer diameter, a latching mechanism configured to selectively move between an engaged position and a retracted position as the outer sleeve moves axially relative to the inner member, wherein, when in the engaged position, at least a portion of the latching mechanism extends outward of the outer sleeve to contact the drill string, and wherein, when in the retracted position, the latching mechanism is constrained within the outer diameter of the outer sleeve and spaced from the drill string, and wherein the latching mechanism comprises a detent mechanism that is positioned within and coupled to the inner member and moveable to a retracted detent position to selectively lock the latching mechanism in the retracted position, wherein in the retracted detent position, the detent mechanism extends outwardly of the inner member to mechanically engage the outer sleeve and prevent axial movement of the outer sleeve relative to the inner member during tripping of the core barrel head assembly, and wherein, upon landing of the core barrel head assembly against the landing ring, the inner member overcomes the mechanical engagement between the detent mechanism and the outer sleeve to move relative to the outer sleeve, and wherein the inner member drives the latching mechanism from the retracted position to the engaged position as the inner member moves relative to the outer sleeve.

8. The core barrel head assembly of claim 7, further comprising a retrieval portion coupled to the outer sleeve, wherein the latching mechanism is configured to be moved into the engaged position by fluid pressure applied to the inner member and configured to be moved to the retracted position by a force on the retrieval portion.

9. The core barrel head assembly of claim 7, wherein, following landing of the core barrel head assembly, the inner member is forced to move axially and distally a predetermined distance relative to the outer sleeve to selectively lock the latching mechanism in the engaged position.

10. A drilling system comprising:

a drill string having an outer core barrel defining a landing ring, wherein the drill string comprises at least one drill rod section having a varying inner diameter and a uniform outer diameter; and a core barrel head assembly configured to be tripped through the drill string to the outer core barrel, comprising:

an inner member;

an outer sleeve moveably coupled to the inner member and having a distal end and an outer diameter;

a non-dragging latching mechanism configured to be tripped into the drill string without dragging against an interior surface of the drill string, wherein the latching mechanism is configured to selectively move between an engaged position and a retracted position as the outer sleeve moves axially relative to the inner member, wherein, when in the engaged position, at least a portion of the latching mechanism extends outward of the outer diameter of the outer sleeve, and wherein the non-dragging latching mechanism comprises a detent mechanism that is positioned within the inner member and moveable to a retracted detent position to selectively lock the latching mechanism in the retracted position, wherein in the retracted detent position, the detent mechanism extends outwardly of the inner member to mechanically engage the outer sleeve and prevent axial movement of the outer sleeve relative to the inner member during tripping of the core barrel head assembly.

11. The drilling system of claim 10, wherein, when in the retracted position, the latching mechanism is constrained within the outer diameter of the outer sleeve.

12. The drilling system of claim 11, further comprising a retrieval portion coupled to the outer sleeve and configured to be connected to a wireline cable.

13. The drilling system of claim 12, wherein the retrieval portion comprises a spearhead that is moveably coupled to the outer sleeve.

14. The drilling system of claim 12, wherein the detent mechanism is configured to selectively lock the latching mechanism in the retracted position irrespective of a position of the retrieval portion relative to the outer sleeve.

15. The drilling system of claim 10, wherein the at least one drill rod section of the drill string has an end portion with a first wall thickness and a middle portion with a second wall thickness, and wherein the first wall thickness is greater than the second wall thickness.

16. A drilling method, comprising:

tripping a core barrel head assembly through a drill string, the drill string having an outer core barrel that defines a landing ring, wherein the core barrel head assembly comprises an outer sleeve and a latching mechanism, wherein the latching mechanism of the core barrel head assembly is tripped into the drill string without dragging the latching mechanism against an interior surface of the drill string, wherein the latching mechanism is configured to selectively move between an engaged position and a retracted position, wherein the latching mechanism comprises a detent mechanism that selectively locks the latching mechanism in the retracted position, wherein the detent mechanism holds the latching mechanism in the retracted position until the core barrel head assembly lands against the landing ring; and following landing of the core barrel head assembly against the landing ring, effecting movement of the latching mechanism from the retracted position to the engaged position, wherein when in the engaged position, at least a portion of the latching mechanism extends outward of the outer sleeve of the core barrel head assembly.

17. The drilling method of claim 16, wherein the latching mechanism comprises a fluid-driven latching mechanism.

18. The drilling method of claim 16, wherein the detent mechanism is configured to selectively retain the latching mechanism in the engaged position.

19. The drilling method of claim 16, further comprising coupling a retrieval portion to the outer sleeve of the core barrel head assembly.

20. The drilling method of claim 16, further comprising moveably coupling an inner member of the core barrel head assembly to the outer sleeve.

21. The drilling method of claim 20, wherein the latching mechanism is moved into the engaged position by fluid pressure applied to the inner member and moved to the retracted position by a force on the retrieval portion.

22. The drilling method of claim 20, wherein the detent mechanism selectively prevents movement of the outer sleeve relative to the inner member.

23. The drilling method of claim 16, wherein the latching mechanism comprises one or more of latch arms, latch balls, latch rollers, or multi-component linkages.

24. The drilling method of claim 16, wherein the drill string comprises at least one drill rod section having a varying inner diameter and a uniform outer diameter.

* * * * *